US009715184B2

(12) United States Patent
Ashizawa et al.

(10) Patent No.: US 9,715,184 B2
(45) Date of Patent: Jul. 25, 2017

(54) METHOD FOR PRODUCING TONER FOR DEVELOPING ELECTROSTATIC IMAGES

(71) Applicant: KAO CORPORATION, Chuo-ku (JP)

(72) Inventors: Takeshi Ashizawa, Wakayama (JP); Shogo Watanabe, Izumiotsu (JP)

(73) Assignee: Kao Corporation, Chuo-ku (JP)

( * ) Notice: Subject to any disclaimer, the term of this patent is extended or adjusted under 35 U.S.C. 154(b) by 0 days.

(21) Appl. No.: 14/432,061

(22) PCT Filed: Oct. 18, 2013

(86) PCT No.: PCT/JP2013/078323
§ 371 (c)(1),
(2) Date: Mar. 27, 2015

(87) PCT Pub. No.: WO2014/069257
PCT Pub. Date: May 8, 2014

(65) Prior Publication Data

US 2015/0323877 A1 Nov. 12, 2015

(30) Foreign Application Priority Data

Nov. 1, 2012 (JP) ..... 2012-242041

(51) Int. Cl.
*G03G 9/087* (2006.01)
*G03G 9/08* (2006.01)

(52) U.S. Cl.
CPC ..... *G03G 9/081* (2013.01); *G03G 9/08755* (2013.01); *G03G 9/08795* (2013.01); *G03G 9/08797* (2013.01)

(58) Field of Classification Search
CPC . G03G 9/081; G03G 9/08755; G03G 9/08775
See application file for complete search history.

(56) References Cited

U.S. PATENT DOCUMENTS

| | | | | |
|---|---|---|---|---|
| 7,820,353 | B2 | 10/2010 | Eida et al. | |
| 8,815,488 | B2 | 8/2014 | Ashizawa | |
| 8,852,841 | B2 | 10/2014 | Ashizawa et al. | |
| 8,921,022 | B2 | 12/2014 | Ashizawa et al. | |
| 2001/0003636 | A1* | 6/2001 | Suwa | G03G 9/08748 430/109.1 |
| 2009/0123863 | A1 | 5/2009 | Ashizawa et al. | |
| 2009/0142687 | A1* | 6/2009 | Ariyoshi | G03G 9/081 430/109.4 |
| 2009/0170020 | A1 | 7/2009 | Kubo et al. | |
| 2014/0120465 | A1 | 5/2014 | Watanabe et al. | |

FOREIGN PATENT DOCUMENTS

| | | | | |
|---|---|---|---|---|
| JP | 2002-55490 | A | 2/2002 | |
| JP | 2002-55491 | A | 2/2002 | |
| JP | 2003-323002 | A | 11/2003 | |
| JP | 2006-091278 | * | 4/2006 | G03G 9/087 |
| JP | 2006-91278 | A | 4/2006 | |
| JP | 2006-285150 | A | 10/2006 | |
| JP | 2007-271820 | A | 10/2007 | |
| JP | 2008-250171 | A | 10/2008 | |
| JP | 2009-134007 | A | 6/2009 | |
| JP | 2009-230064 | A | 10/2009 | |
| JP | 2010-060847 | | 3/2010 | |
| JP | 2010-262255 | A | 11/2010 | |
| JP | 2010-271583 | A | 12/2010 | |
| JP | 2011-141490 | A | 7/2011 | |
| JP | 2012-067534 | | 4/2012 | |

OTHER PUBLICATIONS

Translation of JP 2006-091278 published Apr. 2006.*
International Search Report issued Dec. 17, 2013 in PCT/JP2013/078323.
Extended European Search Report issued May 6, 2016 in Patent Application No. 13850226.5.

* cited by examiner

*Primary Examiner* — Peter Vajda
(74) *Attorney, Agent, or Firm* — Oblon, McClelland, Maier & Neustadt, L.L.P.

(57) ABSTRACT

A method for producing a toner for electrostatic image development containing at least an amorphous polyester and a crystalline polylactic acid, including step 1: mixing an amorphous polyester and a crystalline polylactic acid at a temperature of from 140° to 250° C.; step 2: melt-kneading a mixture obtained in the step 1; and step 3: pulverizing and classifying a melt-kneaded product obtained in the step 2; and a toner for electrostatic image development obtainable by the method. The toner for electrostatic image development obtainable by the method of the present invention is suitably used in development or the like of latent images formed in an electrostatic development method, an electrostatic recording method, an electrostatic printing method, or the like.

20 Claims, No Drawings

METHOD FOR PRODUCING TONER FOR DEVELOPING ELECTROSTATIC IMAGES

CROSS REFERENCE TO RELATED APPLICATION

This application is a 371 of PCT/JP 2013/078323, filed on Oct. 18, 2013, and claims priority to Japanese Patent Application No. 2012-242041, filed on Nov. 1, 2012.

TECHNICAL FIELD

The present invention relates to a toner for electrostatic image development usable in development or the like of latent images formed in an electrostatic development method, an electrostatic recording method, an electrostatic printing method, or the like, and a method for producing the toner.

BACKGROUND ART

With the growth of the print-on-demand markets in the recent years, the demands in high reliability for electrophotographic techniques are even more increasing. Especially, it has been earnestly desired that toners usable in electrophotographic methods have even more improved properties in durability, heat-resistant storage property, and high-temperature offset resistance, and the like.

On the other hand, in toners, which are developers for electrophotographic methods, use of a polylactic acid, which is a plant-derived raw material, has been studied, for the purpose of reducing environmental loads.

For example, for the purpose of obtaining a toner having excellent low-temperature fusing ability and gloss, disclosed is a method for producing a toner, including a molten mixing step including mixing a lignin-based compound and a polylactic acid in a molten state, thereby causing a transesterification reaction between the lignin-based compound and the polylactic acid, to provide a reaction product as a resin binder (see Patent Publication 1).

In addition, disclosed is a toner for electrophotography prepared by subjecting a raw material mixture containing a resin binder comprising a polylactic acid and a colorant to a kneading treatment for a plural times having reduced environmental loads during the production and the waste treatment (see Patent Publication 2).

Further, disclosed is a toner for electrophotography characterized by the use of a resin containing a degradable polyester resin comprising a poly α-hydroxycarboxylic acid and a polyester-based resin other than the above that shows excellent deinking property and a degree of whiteness, and has excellent wax dispersibility, fusing ability, pulverizability, hot offset resistance, and storage property, thereby showing excellent properties as a toner for electrophotography (see Patent Publications 3 and 4).

PRIOR ART REFERENCES

Patent Publications

Patent Publication 1: Japanese Patent Laid-Open No. 2011-141490

Patent Publication 2: Japanese Patent Laid-Open No. 2009-230064

Patent Publication 3: Japanese Patent Laid-Open No. 2003-323002

Patent Publication 4: Japanese Patent Laid-Open No. 2002-55491

SUMMARY OF THE INVENTION

Problems to be Solved by the Invention

However, in the prior art techniques of Patent Publications 1 to 4, or the like, durability, heat-resistant storage property, and high-temperature offset resistance are still insufficient.

The present invention relates to a toner for electrostatic image development having excellent durability, heat-resistant storage property, and high-temperature offset resistance, and a method for producing the same.

Means to Solve the Problems

The present invention relates to:

[1] a method for producing a toner for electrostatic image development containing at least an amorphous polyester and a crystalline polylactic acid, including:

step 1: mixing an amorphous polyester and a crystalline polylactic acid at a temperature of from 140° to 250° C.;

step 2: melt-kneading a mixture obtained in the step 1; and step 3: pulverizing and classifying a melt-kneaded product obtained in the step 2; and

[2] a toner for electrostatic image development obtainable by the method as defined in the above [1].

Effects of the Invention

The toner for electrostatic image development obtainable by the method of the present invention has excellent durability, heat-resistant storage property, and high-temperature offset resistance.

MODES FOR CARRYING OUT THE INVENTION

The method of the present invention is a method for producing a toner for electrostatic image development containing at least an amorphous polyester and a crystalline polylactic acid, characterized in that the method includes mixing an amorphous polyester and a crystalline polylactic acid at a particular temperature (step 1). The toner for electrostatic image development obtained by this method exhibits some effects of having excellent durability, heat-resistant storage property, and high-temperature offset resistance.

Although the reasons why such effects are exhibited are not certain, they are considered as follows. A crystalline polylactic acid has a very high-crystalline property, and is not compatible with an amorphous polyester. For this reason, even when melt-kneaded, a crystalline polylactic acid remains in a separate state without being dispersed in an amorphous polyester, and thereby a toner cannot be produced therefrom. However, when a crystalline polylactic acid and an amorphous polyester are previously mixed at a specified temperature, a part of the crystalline polylactic acid is amorphized, and the amorphized part of this crystalline polylactic acid can be made compatible with the amorphous polyester. By melt-kneading this mixture, a toner in which a crystalline polylactic acid is dispersed in an amorphous polyester can be obtained, without separating the crystalline polylactic acid and the amorphous polyester. Also, it is considered that a crystalline polylactic acid having high crystalline property is dispersed in an amorphous polyester, so that the resulting toner has excellent durability, heat-resistant storage property, and high-temperature offset resistance.

The method of the present invention includes the following steps 1 to 3:

step 1: mixing an amorphous polyester and a crystalline polylactic acid at a temperature of from 140° to 250° C.;

step 2: melt-kneading a mixture obtained in the step 1; and step 3: pulverizing and classifying a melt-kneaded product obtained in the step 2.

In the step 1, an amorphous polyester and a crystalline polylactic acid are mixed at a given temperature, thereby amorphizing a part of the crystalline polylactic acid, so that it is possible to make the crystalline polylactic acid compatible to the amorphous polyester.

[Amorphous Polyester]

In the present invention, the crystalline property of the polyester is expressed by a crystallinity index defined by a value of a ratio of a softening point to a highest temperature of endothermic peak determined by a scanning differential calorimeter, i.e. softening point/highest temperature of endothermic peak. The amorphous polyester is a polyester having a crystallinity index exceeding 1.4 or less than 0.6. The crystalline property of the polyester can be adjusted by the kinds of the raw material monomers and ratios thereof, production conditions, e.g., reaction temperature, reaction time, cooling rate, and the like. Here, the highest temperature of endothermic peak refers to a temperature of the peak on the highest temperature side among endothermic peaks observed. When a difference between the highest temperature of endothermic peak and the softening point is within 20° C., the highest temperature of endothermic peak is defined as a melting point. When the difference between the highest temperature of endothermic peak and the softening point exceeds 20° C., the peak is a peak temperature ascribed to a glass transition.

The amorphous polyester is obtained by polycondensing an alcohol component and a carboxylic acid component.

The alcohol component includes aliphatic diols, alicyclic diols, aromatic diols, and the like. The aliphatic diols and the aromatic diols are preferred, from the viewpoint of improving high-temperature offset resistance, durability, heat-resistant storage property, and low-temperature fusing ability of the toner. Further, the aliphatic diols are preferred, from the viewpoint of improving low-temperature fusing ability of the toner, and inhibiting background fogging. In addition, the aromatic diols are preferred, from the viewpoint of improving high-temperature offset resistance, durability, and heat-resistant storage property of the toner.

The number of carbon atoms of the aliphatic diol is preferably 2 or more, and more preferably 3 or more, from the viewpoint of improving low-temperature fusing ability of the toner. In addition, the number of carbon atoms is preferably 10 or less, more preferably 8 or less, even more preferably 6 or less, and even more preferably 4 or less, from the viewpoint of improving high-temperature offset resistance, durability, and heat-resistant storage property of the toner, and inhibiting background fogging.

The aliphatic diol includes ethylene glycol, 1,2-propanediol, 1,3-propanediol, 1,2-butanediol, 1,3-butanediol, 1,4-butanediol, 2,3-butanediol, 1,2-pentanediol, 1,3-pentanediol, 1,4-pentanediol, 1,5-pentanediol, 2,3-pentanediol, 2,4-pentanediol, 1,2-hexanediol, 1,3-hexanediol, 1,4-hexanediol, 1,5-hexanediol, 1,6-hexanediol, 2,3-hexanediol, 3,4-hexanediol, 2,4-hexanediol, 2,5-hexanediol, 1,4-butenediol, neopentyl glycol, and the like.

Among them, an aliphatic diol having a hydroxyl group bonded to a secondary carbon atom is preferred, from the viewpoint of improving heat-resistant storage property and low-temperature fusing ability of the toner. The number of carbon atoms of the aliphatic diol is preferably 3 or more, from the viewpoint of improving low-temperature fusing ability of the toner. In addition, the number of carbon atoms is preferably 6 or less, and more preferably 4 or less, from the viewpoint of improving high-temperature offset resistance, durability, and heat-resistant storage property of the toner. Specific preferred examples include 1,2-propanediol, 1,2-butanediol, 1,3-butanediol, 2,3-butanediol, 1,2-pentanediol, 1,3-pentanediol, 2,3-pentanediol, 2,4-pentanediol, and the like. Among them, 1,2-propanediol and 2,3-butanediol are preferred, and 1,2-propanediol is more preferred, from the viewpoint of improving durability, heat-resistant storage property, and low-temperature fusing ability of the toner, and inhibiting background fogging.

The content of the aliphatic diol is preferably 50% by mol or more, more preferably 80% by mol or more, even more preferably 90% by mol or more, and even more preferably substantially 100% by mol, of the alcohol component, from the viewpoint of improving low-temperature fusing ability of the toner, and inhibiting background fogging. The content of the aliphatic diol having a hydroxyl group bonded to a secondary carbon atom is preferably 50% by mol or more, more preferably 80% by mol or more, even more preferably 90% by mol or more, and even more preferably substantially 100% by mol, of the alcohol component, from the viewpoint of improving durability and heat-resistant storage property of the toner.

The aromatic diol includes an alkylene oxide adduct of bisphenol A represented by the formula (I):

(I)

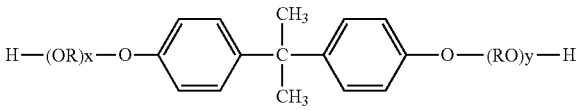

wherein RO and OR are an oxyalkylene group, wherein R is an ethylene and/or propylene group, x and y each shows a number of moles of the alkylene oxide added, each being a positive number, and the sum of x and y on average is preferably from 1 to 16, more preferably from 1 to 8, and even more preferably from 1.5 to 4.

The content of the aromatic diol is preferably 50% by mol or more, more preferably 80% by mol or more, even more preferably 90% by mol or more, and even more preferably substantially 100% by mol, of the alcohol component, from the viewpoint of improving high-temperature offset resistance, durability, and heat-resistant storage property of the toner.

Other alcohol components include trihydric or higher polyhydric alcohols such as glycerol, and the like.

It is preferable that the carboxylic acid component contains an aromatic dicarboxylic acid compound, from the viewpoint of improving high-temperature offset resistance, durability, and heat-resistant storage property of the toner.

The aromatic dicarboxylic acid compound includes phthalic acid, isophthalic acid, terephthalic acid, acid anhydrides thereof, alkyl (1 to 6 carbon atoms) esters thereof, and the like. Here, the carboxylic acid compound refers to dicarboxylic acids, esters formed between carboxylic acids and alcohols having from 1 to 6 carbon atoms, and preferably from 1 to 3 carbon atoms, and acid anhydrides thereof. Among them, the dicarboxylic acids are preferred.

The content of the aromatic dicarboxylic acid compound is preferably 50% by mol or more, more preferably 70% by mol or more, even more preferably 85% by mol or more, and even more preferably 90% by mol or more, of the carboxylic acid component, from the viewpoint of improving high-temperature offset resistance, durability, and heat-resistant storage property of the toner.

Also, it is preferable that a tricarboxylic or higher polycarboxylic acid compound is contained, from the viewpoint of improving high-temperature offset resistance, durability, and heat-resistant storage property of the toner.

The tricarboxylic or higher polycarboxylic acid compound includes, for example, tricarboxylic or higher polycarboxylic acids having from 4 to 30 carbon atoms, preferably from 4 to 20 carbon atoms, and more preferably from 4 to 10 carbon atoms, and acid anhydrides thereof, alkyl esters thereof having from 1 to 6 carbon atoms, and the like. Here, the number of carbon atoms in the carboxylic acid compound does not include the number of carbon atoms of the alkyl group of the alkyl ester.

Specific examples include 1,2,4-benzenetricarboxylic acid (trimellitic acid), 2,5,7-naphthalenetricarboxylic acid, 1,2,4,5-benzenetetracarboxylic acid (pyromellitic acid), and the like, and 1,2,4-benzenetricarboxylic acid (trimellitic acid) and an acid anhydride thereof are preferred, and 1,2,4-benzenetricarboxylic acid anhydride (trimellitic anhydride) is more preferred, from the viewpoint of improving high-temperature offset resistance, durability, and heat-resistant storage property of the toner.

The content of the tricarboxylic or higher polycarboxylic acid compound is preferably 20% by mol or less, more preferably 10% by mol or less, and even more preferably 5% by mol or less, from the viewpoint of improving low-temperature fusing ability of the toner.

Other carboxylic acid component includes aliphatic dicarboxylic acids, such as oxalic acid, malonic acid, maleic acid, fumaric acid, succinic acid, adipic acid, sebacic acid, azelaic acid, substituted succinic acids of which substituent is an alkyl group having from 1 to 20 carbon atoms or an alkenyl group having from 2 to 20 carbon atoms; alicyclic dicarboxylic acids such as cyclohexanedicarboxylic acid; rosins such as unpurified rosins and purified rosins; rosins modified with fumaric acid, maleic acid, acrylic acid or the like; acid anhydrides thereof, alkyl (1 to 6 carbon atoms) esters thereof, and the like.

Here, the alcohol component may properly contain a monohydric alcohol, and the carboxylic acid component may properly contain a monocarboxylic acid compound, from the viewpoint of adjusting the softening point of the polyester.

An equivalent ratio, i.e. COOH group or groups/OH group or groups, of the carboxylic acid component and the alcohol component in the amorphous polyester is preferably from 0.70 to 1.15, and more preferably from 0.80 to 1.00, from the viewpoint of reducing an acid value of the polyester.

The polycondensation reaction of the alcohol component and the carboxylic acid component can be carried out by polycondensing the components in an inert gas atmosphere at a temperature of from 180° to 250° C. or so, optionally in the presence of an esterification catalyst, an esterification promoter, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The amount of the esterification catalyst used is preferably from 0.01 to 1.5 parts by mass, and more preferably from 0.1 to 1.0 part by mass, based on 100 parts by mass of a total amount of the alcohol component and the carboxylic acid component. The esterification promoter includes gallic acid, and the like. The amount of the esterification promoter used is preferably from 0.001 to 0.5 parts by mass, and more preferably from 0.01 to 0.1 parts by mass, based on 100 parts by mass of a total amount of the alcohol component and the carboxylic acid component. The polymerization inhibitor includes tert-butyl catechol and the like. The amount of the polymerization inhibitor used is preferably from 0.001 to 0.5 parts by mass, and more preferably from 0.01 to 0.1 parts by mass, based on 100 parts by mass of a total amount of the alcohol component and the carboxylic acid component.

The softening point of the amorphous polyester is preferably 80° C. or higher, more preferably 90° C. or higher, and even more preferably 100° C. or higher, from the viewpoint of improving high-temperature offset resistance, durability, and heat-resistant storage property of the toner. Also, the softening point is preferably 160° C. or lower, more preferably 140° C. or lower, and even more preferably 120° C. or lower, from the viewpoint of improving low-temperature fusing ability of the toner.

The softening point of the amorphous polyester can be controlled by adjusting the kinds and compositional ratios of the alcohol component and the carboxylic acid component, an amount of a catalyst, or the like, or selecting reaction conditions such as reaction temperature, reaction time and reaction pressure.

The highest temperature of endothermic peak of the amorphous polyester is preferably 50° C. or higher, more preferably 55° C. or higher, and even more preferably 60° C. or higher, from the viewpoint of improving high-temperature offset resistance, durability, and heat-resistant storage property of the toner. Also, the highest temperature of endothermic peak is preferably 90° C. or lower, more preferably 80° C. or lower, and even more preferably 70° C. or lower, from the viewpoint of improving low-temperature fusing ability of the toner.

The highest temperature of endothermic peak of the amorphous polyester can be controlled by the kinds, compositional ratios or the like of the alcohol component or the carboxylic acid component.

The glass transition temperature of the amorphous polyester is preferably 50° C. or higher, more preferably 55° C. or higher, and even more preferably 60° C. or higher, from the viewpoint of improving high-temperature offset resistance, durability, and heat-resistant storage property of the toner. Also, the glass transition temperature is preferably 90° C. or lower, more preferably 80° C. or lower, and even more preferably 70° C. or lower, from the viewpoint of improving low-temperature fusing ability of the toner.

The glass transition temperature of the amorphous polyester can be controlled by the kinds, compositional ratios and the like of the alcohol component or the carboxylic acid component.

The acid value of the amorphous polyester is preferably 30 mgKOH/g or less, more preferably 20 mgKOH/g or less, and even more preferably 15 mgKOH/g or less, from the viewpoint of improving high-temperature offset resistance, heat-resistant storage property, and durability of the toner. In addition, the acid value is preferably 1 mgKOH/g or more, more preferably 2 mgKOH/g or more, and even more preferably 3 mgKOH/g or more, from the viewpoint of improving productivity of the amorphous polyester, and from the viewpoint of improving low-temperature fusing ability of the toner.

The acid value of the amorphous polyester can be controlled by adjusting the kinds and compositional ratios of the alcohol component and the carboxylic acid component, an amount of a catalyst, or the like, or selecting reaction conditions such as reaction temperature, reaction time and reaction pressure.

In the present invention, two or more kinds of amorphous polyesters may be used.

Here, in the present invention, the polyester may be a modified polyester to an extent that the properties thereof are not substantially impaired. The modified polyester refers to, for example, a polyester grafted or blocked with a phenol, a urethane, an epoxy or the like according to a method described in Japanese Patent Laid-Open No. Hei-11-133668, Hei-10-239903, Hei-8-20636, or the like.

[Crystalline Polylactic Acid]

In the present invention, the crystalline property of the polylactic acid used in the step 1 is expressed by a degree of crystallinity. The degree of crystallinity can be obtained in accordance with a method described in Examples.

The degree of crystallinity of the crystalline polylactic acid used in the step 1 is preferably 30% or more, more preferably 50% or more, even more preferably 70% or more, even more preferably 80% or more, and even more preferably 90% or more, from the viewpoint of improving high-temperature offset resistance, durability, and heat-resistant storage property of the toner.

The crystalline polylactic acid may be a homopolymer of lactic acid, or may be a copolymer of lactic acid with another hydroxycarboxylic acid.

The lactic acid, which is a monomer of the crystalline polylactic acid may be either L-lactic acid or D-lactic acid.

Other hydroxycarboxylic acids include hydroxycarboxylic acids having from 3 to 8 carbon atoms, specifically including glycolic acid, hydroxybutyric acid, hydroxyvaleric acid, hydroxypentanoic acid, hydroxycaproic acid, hydroxyheptanoic acid, and the like.

In the present invention, the content of the lactic acid is preferably 80% by mol or more, more preferably 90% by mol or more, and even more preferably substantially 100% by mol, of the monomers constituting the crystalline polylactic acid, from the viewpoint of improving high-temperature offset resistance, durability, and heat-resistant storage property of the toner. Therefore, the crystalline polylactic acid is preferably a homopolymer of lactic acid, rather than a copolymer of lactic acid and other hydroxycarboxylic acid.

The crystalline polylactic acid can be produced by polycondensing lactic acids, or polycondensing lactic acid and another hydroxycarboxylic acid, in accordance with a conventional method. In the present invention, commercially available crystalline polylactic acids, for example, "N-3000" (glass transition temperature: 63° C.), and "N-4000" (glass transition temperature: 61° C.) (hereinabove, homopolymers of lactic acids, manufactured by Nature Works LLC) can also be used.

The number-average molecular weight of the crystalline polylactic acid used in the step 1 is preferably 25,000 or more, more preferably 50,000 or more, even more preferably 100,000 or more, even more preferably 150,000 or more, and even more preferably 180,000 or more, from the viewpoint of containing a crystalline polylactic acid in the toner, and from the viewpoint of improving high-temperature offset resistance, durability, and heat-resistant storage property of the toner. In addition, the number-average molecular weight is preferably 300,000 or less, more preferably 250,000 or less, and even more preferably 200,000 or less, from the viewpoint of making it possible to melt-knead the mixture, whereby a toner can be obtained, and from the viewpoint of improving high-temperature offset resistance, durability, heat-resistant storage property, and low-temperature fusing ability of the toner.

The weight-average molecular weight of the crystalline polylactic acid used in the step 1 is preferably 30,000 or more, more preferably 100,000 or more, even more preferably 250,000 or more, even more preferably 400,000 or more, and even more preferably 450,000 or more, from the viewpoint of containing a crystalline polylactic acid in the toner, and from the viewpoint of improving high-temperature offset resistance, durability, and heat-resistant storage property of the toner. In addition, the weight-average molecular weight is preferably 700,000 or less, more preferably 550,000 or less, and even more preferably 500,000 or less, from the viewpoint of making it possible to melt-knead the mixture, whereby a toner can be obtained, and from the viewpoint of improving high-temperature offset resistance, durability, heat-resistant storage property, and low-temperature fusing ability of the toner.

The number-average molecular weight and the weight-average molecular weight of the crystalline polylactic acid can be adjusted not only by adjusting polymerization conditions such as polycondensation reaction time during the production, but also by allowing an already known crystalline polylactic acid to stand under high-temperature, high-humidity environmental conditions. When allowed to stand under high-temperature, high-humidity environmental conditions, the longer the time, the smaller the average molecular weight.

The temperature at which the crystalline polylactic acid is allowed to stand is preferably equal to or higher than a glass transition temperature of the polylactic acid, more preferably 65° C. or higher, and even more preferably 70° C. or higher, and preferably 100° C. or lower, and more preferably 90° C. or lower, from the viewpoint of facilitating controls of the number-average molecular weight and the weight-average molecular weight. In addition, the humidity at which the crystalline polylactic acid is allowed to stand is preferably 50% or more, more preferably 70% or more, even more preferably 80% or more, and even more preferably 90% or more, from the viewpoint of facilitating controls of the number-average molecular weight and the weight-average molecular weight.

The melting point of the crystalline polylactic acid used in the step 1 is preferably 155° C. or higher, and more preferably 160° C. or higher, from the viewpoint of improving high-temperature offset resistance, durability, and heat-resistant storage property of the toner. Also, the melting point is preferably 180° C. or lower, and more preferably 175° C. or lower, from the viewpoint of improving low-temperature fusing ability of the toner.

The amount of the crystalline polylactic acid used in the step 1 is preferably 5% by mass or more, more preferably 10% by mass or more, even more preferably 15% by mass or more, and even more preferably 20% by mass or more, of total parts by mass (total amount) of the crystalline polylactic acid and the amorphous polyester, from the viewpoint of improving high-temperature offset resistance of the toner.

In addition, the amount of the crystalline polylactic acid used in the step 1 is preferably 5% by mass or more, more preferably 10% by mass or more, even more preferably 15% by mass or more, even more preferably 20% by mass or more, and even more preferably 30% by mass or more, of a total amount of the crystalline polylactic acid and the amorphous polyester, from the viewpoint of improving heat-resistant storage property of the toner.

In addition, the amount of the crystalline polylactic acid used in the step 1 is preferably 5% by mass or more, more preferably 10% by mass or more, even more preferably 15% by mass or more, even more preferably 20% by mass or more, and even more preferably 25% by mass or more, and preferably 50% by mass or less, and more preferably 45% by mass or less, of a total amount of the crystalline polylactic acid and the amorphous polyester, from the viewpoint of improving durability of the toner.

On the other hand, although a part of the crystalline polylactic acid is amorphized by mixing an amorphous polyester and a crystalline polylactic acid at a given temperature, in the present invention, it is preferable that the crystalline polylactic acid is maintained in the resulting toner, from the viewpoint of improving high-temperature offset resistance, durability, and heat-resistant storage property of the toner. Whether or not a crystalline polylactic acid is maintained in the toner can be confirmed by the presence of the crystalline polylactic acid from the crystal melting peak of the resulting toner. In addition, the content and the residual ratio of the crystalline polylactic acid can be estimated from the endothermic amount obtained from the crystal melting peak, and the content and the residual ratio can be obtained in accordance with the methods described in Examples. The content of the crystalline polylactic acid in the toner is preferably 3.0% by mass or more, more preferably 4.0% by mass or more, even more preferably 4.5% by mass or more, even more preferably 5.5% by mass or more, and even more preferably 9.5% by mass or more, of a total amount of the crystalline polylactic acid and the amorphous polyester used in the step 1, from the viewpoint of improving high-temperature offset resistance, durability, and heat-resistant storage property of the toner. In addition, the content of the crystalline polylactic acid in the toner is preferably 50% by mass or less, more preferably 45% by mass or less, and even more preferably 40% by mass or less, from the viewpoint of homogeneously mixing the crystalline polylactic acid in the toner, and from the viewpoint of improving durability of the toner.

The residual ratio of the crystalline polylactic acid in the toner is preferably 10% or more, more preferably 20% or more, even more preferably 25% or more, even more preferably 30% or more, even more preferably 40% or more, even more preferably 60% or more, and even more preferably 70% or more, relative to the crystalline polylactic acid used in the step 1, from the viewpoint of improving high-temperature offset resistance, durability, and heat-resistant storage property of the toner, and from the viewpoint of improving productivity of the toner.

A mass ratio of the amorphous polyester to the crystalline polylactic acid used in the step 1, i.e. amorphous polyester/crystalline polylactic acid, is preferably from 95/5 to 50/50, more preferably from 90/10 to 50/50, even more preferably from 85/15 to 55/45, even more preferably from 80/20 to 55/45, and even more preferably from 75/25 to 55/45, from the viewpoint of improving high-temperature offset resistance, durability, and heat-resistant storage property of the toner.

In the step 1, the mixing temperature of the amorphous polyester and the crystalline polylactic acid is 140° C. or higher, preferably 150° C. or higher, more preferably 170° C. or higher, and even more preferably 190° C. or higher, from the viewpoint of making it possible to melt-knead the mixture, whereby a toner can be obtained, from the viewpoint of improving productivity of the toner, and from the viewpoint of improving high-temperature offset resistance, durability, and heat-resistant storage property of the toner. Also, the mixing temperature is 250° C. or lower, preferably 230° C. or lower, and more preferably 210° C. or lower, from the viewpoint of containing a crystalline polylactic acid in the toner, and from the viewpoint of improving high-temperature offset resistance, durability, and heat-resistant storage property of the toner.

The mixing time in the step 1 cannot be unconditionally determined because the mixing time depends upon the mixing temperature, and the mixing time is preferably 0.1 hours or more, and more preferably 0.3 hours or more, from the viewpoint of making it possible to melt-knead the mixture, whereby a toner can be obtained, and from the viewpoint of improving high-temperature offset resistance, durability, and heat-resistant storage property of the toner. Also, the mixing time is preferably 15 hours or less, more preferably 10 hours or less, even more preferably 7 hours or less, even more preferably 5 hours or less, even more preferably 3 hours or less, even more preferably 2 hours or less, and even more preferably 1.5 hours or less, from the viewpoint of containing a crystalline polylactic acid in the toner, from the viewpoint of improving high-temperature offset resistance, durability, and heat-resistant storage property of the toner, and from the viewpoint of improving productivity of the toner.

The mixing method may be any one of the following:

(A) a method including mixing an amorphous polyester and a crystalline polylactic acid, and heating the mixture to melt;

(B) a method including previously heating an amorphous polyester to melt, and mixing a molten amorphous polyester and a crystalline polylactic acid; and (C) a method including previously heating a crystalline polylactic acid to melt, and mixing a molten crystalline polylactic acid and an amorphous polyester.

The method of (B) is preferred, from the viewpoint of containing a crystalline polylactic acid in the toner, and from the viewpoint of improving high-temperature offset resistance, durability, and heat-resistant storage property of the toner. Therefore, the step 1 preferably includes the following steps 1-1 and 1-2:

step 1-1: melting an amorphous polyester; and step 1-2: mixing a molten amorphous polyester and a crystalline polylactic acid at a temperature of from 140° to 250° C.

It is preferable that a mixture obtained in the step 1 is cooled, and pulverized to a particle size of from 0.01 to 2 mm or so, and thereafter subjected to a subsequent step 2.

In the step 2, a mixture obtained in the step 1 is melt-kneaded.

It is preferable that a mixture is melt-kneaded together with toner materials such as a colorant, a charge control agent, and a releasing agent.

As the colorant, all of the dyes, pigments and the like which are used as colorants for toners can be used, and carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used. The toner of the present invention may be any of black toners and color toners. As the colorant, Phthalocyanine Blue 15:3 is preferred, from the viewpoint of improving low-temperature fusing ability and heat-resistant storage property of the toner.

The content of the colorant is preferably 1 part by mass or more, and more preferably 2 parts by mass or more, based on 100 parts by mass of the resin binder, from the viewpoint of improving optical density of the toner. In addition, the content of the colorant is preferably 20 parts by mass or less, more preferably 10 parts by mass or less, and even more preferably 5 parts by mass or less, based on 100 parts by mass of the resin binder, from the viewpoint of improving low-temperature fusing ability and heat-resistant storage property of the toner.

As the charge control agent, any of negatively chargeable charge control agents and positively chargeable charge control agents can be used.

The negatively chargeable charge control agent includes metal-containing azo dyes, copper phthalocyanine dyes, metal complexes of alkyl derivatives of salicylic acid, nitroimidazole derivatives, boron complexes of benzilic acid, and the like. The metal-containing azo dyes include, for example, "VARIFAST BLACK 3804," "BONTRON S-28," "BONTRON S-31," "BONTRON S-32," "BONTRON S-34," "BONTRON S-36," hereinabove manufactured by Orient Chemical Industries Co., Ltd.; "T-77," "AIZEN SPILON BLACK TRH," hereinabove manufactured by Hodogaya Chemical Co., Ltd., and the like. The metal complexes of alkyl derivatives of salicylic acid include, for example, "BONTRON E-81," "BONTRON E-82," "BONTRON E-84," "BONTRON E-85," "BONTRON E-304," hereinabove manufactured by Orient Chemical Industries Co., Ltd., and the like. The boron complexes of benzilic acid include, for example, "LR-147" manufactured by Japan Carlit Co., Ltd., and the like.

The positively chargeable charge control agent includes Nigrosine dyes, triphenylmethane-based dyes, quaternary ammonium salt compounds, polyamine resins, imidazole derivatives, and the like. The Nigrosine dyes include, for example, "Nigrosine Base EX," "Oil Black BS," "Oil Black SO," "BONTRON N-01," "BONTRON N-07," "BONTRON N-09," "BONTRON N-11," hereinabove manufactured by Orient Chemical Industries Co., Ltd., and the like. The triphenylmethane-based dyes include, for example, triphenylmethane-based dyes containing a tertiary amine as a side chain. The quaternary ammonium salt compounds include, for example, "BONTRON P-51," "BONTRON P-52," hereinabove manufactured by Orient Chemical Industries Co., Ltd.; "TP-415" manufactured by Hodogaya Chemical Co., Ltd.; cetyltrimethylammonium bromide, "COPY CHARGE PXVP435," "COPY CHARGE PSY," hereinabove manufactured by Clariant Ltd., and the like. The polyamine resins include, for example, "AFP-B" manufactured by Orient Chemical Industries Co., Ltd., and the like. The imidazole derivatives include, for example, "PLZ-2001," "PLZ-8001," hereinabove manufactured by Shikoku Chemicals Corporation, and the like.

The content of the charge control agent is preferably 0.2 parts by mass or more, and more preferably 0.5 parts by mass or more, and the content is preferably 5 parts by mass or less, and more preferably 3 parts by mass or less, based on 100 parts by mass of the resin binder, from the viewpoint of improving triboelectric stability of the toner.

The releasing agent includes aliphatic hydrocarbon waxes such as polypropylene wax, polyethylene wax, polypropylene polyethylene copolymer wax, microcrystalline wax, paraffin waxes, and Fischer-Tropsch wax, and oxides thereof; ester waxes such as synthetic ester waxes, carnauba wax, montan wax, sazole wax, and deacidified waxes thereof; fatty acid amides, fatty acids, higher alcohols, metal salts of aliphatic acids, and the like. These releasing agents may be used alone or in a mixture of two or more kinds.

The melting point of the releasing agent is preferably 60° C. or higher, more preferably 65° C. or higher, and even more preferably 70° C. or higher, from the viewpoint of improving high-temperature offset resistance, durability, and heat-resistant storage property of the toner. Also, the melting point is preferably 120° C. or lower, more preferably 100° C. or lower, even more preferably 90° C. or lower, and even more preferably 80° C. or lower, from the viewpoint of improving low-temperature fusing ability and gloss of the toner.

The content of the releasing agent is preferably 0.5 parts by mass or more, more preferably 1.0 part by mass or more, and even more preferably 2.0 parts by mass or more, based on 100 parts by mass of the resin binder, from the viewpoint of improving high-temperature offset resistance and low-temperature fusing ability of the toner. The content of the releasing agent is preferably 10 parts by mass or less, more preferably 8 parts by mass or less, and even more preferably 5 parts by mass or less, based on 100 parts by mass of the resin binder, from the viewpoint of improving heat-resistant storage property and durability of the toner.

In the present invention, an additive such as a magnetic particulate, a fluidity improver, an electric conductivity modifier, a reinforcing filler such as a fibrous material, an antioxidant, an anti-aging agent, or a cleanability improver may be further properly used.

The melt-kneading can be carried out with a known kneader, such as a closed kneader, a single-screw or twin-screw extruder, or an open-roller type kneader. From the viewpoint of lowering the temperature during melt-kneading, and improving high-temperature offset resistance, durability, heat-resistant storage property, and low-temperature fusing ability of the toner, and from the viewpoint of being capable of efficiently highly dispersing additives such as a colorant, a charge control agent, and a releasing agent, in the toner without repeats of kneading or without a dispersion aid, it is preferable to that the melt-kneading is carried out with an open-roller type kneader, and the open-roller type kneader is more preferably provided with feeding ports and a discharging port for a kneaded product along the shaft direction of the roller.

It is preferable that the toner components, such as a mixture, a colorant, a charge control agent, and a releasing agent, are previously mixed with a mixer such as a Henschel mixer or a ball-mill, and thereafter fed to a kneader.

When the mixture is fed to the open-roller type kneader, the mixture may be fed from one feeding port, or dividedly fed to the kneader from plural feeding ports. It is preferable that the mixture is fed to the kneader from one feeding port, from the viewpoint of easiness of operation and simplification of an apparatus.

The open-roller type kneader refers to a kneader of which kneading unit is an open type, not being tightly closed, and the kneading heat generated during the kneading can be easily dissipated. In addition, it is preferable that the continuous open-roller type kneader is a kneader provided with at least two rollers. The continuous open-roller type kneader usable in the present invention is preferably a kneader provided with two rollers having different peripheral speeds, in other words, two rollers of a high-rotation roller having a high peripheral speed and a low-rotation roller having a low peripheral speed. In the present invention, it is preferable that the high-rotation roller is a heat roller, and that the low-rotation roller is a cooling roller, from the viewpoint of improving dispersibility of the additives such as a colorant, a charge control agent, and a releasing agent, in the toner, from the viewpoint of reducing mechanical strength during the melt-kneading, thereby controlling heat generation, and from the viewpoint of lowering the temperature during melt-kneading, thereby improving high-temperature offset resistance, durability, heat-resistant storage property, and low-temperature fusing ability of the toner.

The temperature of the roller can be adjusted by, for example, a temperature of a heating medium passing through the inner portion of the roller, and each roller may be divided in two or more portions in the inner portion of the roller, each being passed through with heating media of different temperatures.

The temperature at the end part of the raw material-supplying side of the high-rotation roller is preferably 100° C. or higher and 160° C. or lower, from the viewpoint of reducing mechanical strength during the melt-kneading, thereby controlling heat generation, and from the viewpoint of improving high-temperature offset resistance, durability, heat-resistant storage property, and low-temperature fusing ability of the toner, and the temperature at the end part of the raw material-supplying side of the low-rotation roller is preferably 30° C. or higher and 100° C. or lower, from the same viewpoint.

In the high-rotation roller, the difference between setting temperatures of the end part of the raw material-supplying side and the end part of the kneaded product-discharging side is preferably 20° C. or more, and more preferably 30° C. or more, from the viewpoint of preventing detachment of the kneaded product from the roller, from the viewpoint of reducing mechanical strength during the melt-kneading, thereby controlling heat generation, and from the viewpoint of improving high-temperature offset resistance, durability, heat-resistant storage property, and low-temperature fusing ability of the toner. Moreover, the difference between the setting temperatures is preferably 60° C. or less, and more preferably 50° C. or less.

In the low-rotation roller, the difference between setting temperatures of the end part of the raw material-supplying side and the end part of the kneaded product-discharging side is preferably 50° C. or less, from the viewpoint of improving dispersibility of the additives such as a colorant, a charge control agent, and a releasing agent, in the toner, from the viewpoint of reducing mechanical strength during the melt-kneading, thereby controlling heat generation, and from the viewpoint of improving high-temperature offset resistance, durability, heat-resistant storage property, and low-temperature fusing ability of the toner.

The peripheral speed of the high-rotation roller is preferably 2 m/min or more, more preferably 10 m/min or more, and even more preferably 25 m/min or more, and preferably 100 m/min or less, more preferably 75 m/min or less, and even more preferably 50 m/min or less, from the viewpoint of improving dispersibility of the additives such as a colorant, a charge control agent, and a releasing agent, in the toner, from the viewpoint of reducing mechanical strength during the melt-kneading, thereby controlling heat generation, and from the viewpoint of improving high-temperature offset resistance, durability, heat-resistant storage property, and low-temperature fusing ability of the toner.

The peripheral speed of the low-rotation roller is preferably 1 m/min or more, more preferably 5 m/min or more, and even more preferably 15 m/min or more, and preferably 90 m/min or less, more preferably 60 m/min or less, and even more preferably 30 m/min or less, from the same viewpoint. In addition, the ratio of the peripheral speeds of the two rollers, i.e., low-rotation roller/high-rotation roller, is preferably from 1/10 to 9/10, and more preferably from 3/10 to 8/10.

Structures, size, materials and the like of the roller are not particularly limited. Also, the surface of the roller may be any of smooth, wavy, rugged, or other surfaces. From the viewpoint of increasing kneading share and improving dispersibility of the additives such as a colorant, a charge, control agent, and a releasing agent, in the toner, from the viewpoint of reducing mechanical strength during the melt-kneading, thereby controlling heat generation, and from the viewpoint of improving high-temperature offset resistance, durability, heat-resistant storage property, and low-temperature fusing ability of the toner, it is preferable that plural spiral ditches are engraved on the surface of each roller.

The melt-kneaded product obtained in the step 2 is cooled to a pulverizable temperature, and thereafter subjected to a subsequent step 3.

In the step 3, the melt-kneaded product obtained in the step 2 is pulverized and classified.

The pulverizing step may be carried out in divided multi-stages. For example, the resin kneaded product may be roughly pulverized to a size of from 1 to 5 mm or so, and the roughly pulverized product may then be further finely pulverized to a desired particle size.

The pulverizer usable in the pulverizing step is not particularly limited. For example, the pulverizer preferably usable in the rough pulverization includes a hammer-mill, an atomizer, Rotoplex, and the like, and the pulverizer preferably usable in the fine pulverization includes a fluidised bed opposed jet mill, an impact type jet mill, a rotary mechanical mill, and the like. It is preferable to use a fluidised bed opposed jet mill and an impact type jet mill, and it is more preferable to use a fluidised bed opposed jet mill, from the viewpoint of pulverization efficiency.

The classifier used in the classification step includes a rotor type classifier, an air classifier, a rotor type classifier, a sieve classifier, and the like. The pulverized product which is insufficiently pulverized and removed during the classifying step may be subjected to the pulverization step again, and the pulverization step and the classification step may be repeated as occasion demands.

In the method for producing a toner of the present invention, it is preferable that the method further includes, subsequent to the pulverizing and classifying step, the step of mixing the toner particles obtained, in other words, toner matrix particles, with an external additive, from the viewpoint of improving triboelectric chargeability, fluidity and transferability of the toner. Specific examples of the external additive include inorganic particles of silica, alumina, titania, zirconia, tin oxide, zinc oxide, and the like, and fine organic particles such as fine melamine resin particles and fine polytetrafluoroethylene resin particles. Two or more kinds of the external additives may be used in combination. Among them, silica is preferred, and a hydrophobic silica that is hydrophobically treated is more preferred, from the viewpoint of improving transferability of the toner.

The volume-average particle size of the external additive is preferably 10 nm or more, and more preferably 15 nm or more, and the volume-average particle size is preferably 250 nm or less, more preferably 200 nm or less, and even more preferably 90 nm or less, from the viewpoint of improving triboelectric chargeability, fluidity, and transferability of the toner.

The content of the external additive is preferably 0.05 parts by mass or more, more preferably 0.1 parts by mass or more, and even more preferably 0.3 parts by mass or more, based on 100 parts by mass of the toner matrix particles before the treatment with the external additive, from the viewpoint of improving triboelectric chargeability, fluidity, and transferability of the toner. In addition, the content of the external additive is preferably 5 parts by mass or less, more preferably 4 parts by mass or less, and even more preferably 3 parts by mass or less, based on 100 parts by mass of the toner matrix particles before the treatment.

In the mixing of the toner matrix particles with an external additive, a mixer equipped with an agitating member such as rotary blades is preferably used, preferably a high-speed mixer such as a Henschel mixer or Super Mixer, and more preferably a Henschel mixer.

The toner of the present invention has a volume-median particle size $D_{50}$ of preferably 3 μm or more, more preferably 4 μm or more, and even more preferably from 6 μm or more, from the viewpoint of improving the image quality of the toner. Also, the toner has a volume-median particle size of preferably 15 μm or less, more preferably 12 μm or less, and even more preferably 9 μm or less. The volume-median particle size $D_{50}$ as used herein means a particle size of which cumulative volume frequency calculated on a volume percentage is 50% counted from the smaller particle sizes. Also, in a case where the toner is treated with an external additive, the volume-median particle size of the toner is regarded as a volume-median particle size of the toner matrix particles.

The toner obtained by the method of the present invention can be used directly as a toner for monocomponent development, or used in a mixture with a carrier as a toner for two-component development, in an apparatus for forming fused images of a monocomponent development or a two-component development.

Regarding the embodiments mentioned above, the present invention will further disclose the method for producing a toner for electrostatic image development and the toner for electrostatic image development as set forth below.

[1] a method for producing a toner for electrostatic image development containing at least an amorphous polyester and a crystalline polylactic acid, including:

step 1: mixing an amorphous polyester and a crystalline polylactic acid at a temperature of from 140° to 250° C.;

step 2: melt-kneading a mixture obtained in the step 1; and step 3: pulverizing and classifying a melt-kneaded product obtained in the step 2;

[2] the method for producing a toner for electrostatic image development according to the above [1], wherein the amorphous polyester is obtained by polycondensing an alcohol component and a carboxylic acid component, wherein the alcohol component preferably contains at least one member selected from the group consisting of aliphatic diols, alicyclic diols, and aromatic diols, and preferably contains an aliphatic diol and/or an aromatic diol;

[3] the method for producing a toner for electrostatic image development according to the above [2], wherein the number of carbon atoms of the aliphatic diol is preferably 2 or more, and more preferably 3 or more, and preferably 10 or less, more preferably 8 or less, even more preferably 6 or less, and even more preferably 4 or less;

[4] the method for producing a toner for electrostatic image development according to the above [2] or [3], wherein the aliphatic diol is preferably an aliphatic diol having a hydroxyl group bonded to a secondary carbon atom;

[5] the method for producing a toner for electrostatic image development according to the above [4], wherein the number of carbon atoms of the aliphatic diol having a hydroxyl group bonded to a secondary carbon atom is preferably 3 or more, and preferably 6 or less, and more preferably 4 or less;

[6] the method for producing a toner for electrostatic image development according to the above [4], wherein the aliphatic diol having a hydroxyl group bonded to a secondary carbon atom is preferably at least one member selected from the group consisting of 1,2-propanediol, 1,2-butanediol, 1,3-butanediol, 2,3-butanediol, 1,2-pentanediol, 1,3-pentanediol, 2,3-pentanediol, and 2,4-pentanediol, more preferably 1,2-propanediol and/or 2,3-butanediol, and even more preferably 1,2-propanediol;

[7] the method for producing a toner for electrostatic image development according to any one of the above [4] to [6], wherein the content of the aliphatic diol having a hydroxyl group bonded to a secondary carbon atom is preferably 50% by mol or more, more preferably 80% by mol or more, even more preferably 90% by mol or more, and even more preferably substantially 100% by mol, of the alcohol component;

[8] the method for producing a toner for electrostatic image development according to any one of the above [2] to [7], wherein the content of the aliphatic diol is preferably 50% by mol or more, more preferably 80% by mol or more, even more preferably 90% by mol or more, and even more preferably substantially 100% by mol, of the alcohol component;

[9] the method for producing a toner for electrostatic image development according to any one of the above [2] to [8], wherein the aromatic diol is preferably an alkylene oxide adduct of bisphenol A represented by the formula (I);

[10] the method for producing a toner for electrostatic image development according to any one of the above [2] to [9], wherein the content of the aromatic diol is preferably 50% by mol or more, more preferably 80% by mol or more, even more preferably 90% by mol or more, and even more preferably substantially 100% by mol, of the alcohol component;

[11] the method for producing a toner for electrostatic image development according to any one of the above [2] to [10], wherein the carboxylic acid component preferably contains an aromatic dicarboxylic acid compound, and more preferably contains at least one member selected from the group consisting of phthalic acid, isophthalic acid, and terephthalic acid;

[12] the method for producing a toner for electrostatic image development according to the above [11], wherein the content of the aromatic dicarboxylic acid compound is preferably 50% by mol or more, more preferably 70% by mol or more, even more preferably 85% by mol or more, and even more preferably 90% by mol or more, of the carboxylic acid component;

[13] the method for producing a toner for electrostatic image development according to any one of the above [2] to [12], wherein the carboxylic acid component preferably contains a tricarboxylic or higher polycarboxylic acid compound;

[14] the method for producing a toner for electrostatic image development according to the above [13], wherein the tricarboxylic or higher polycarboxylic acid compound is preferably 1,2,4-benzenetricarboxylic acid (trimellitic acid) and/or an acid anhydride thereof, and more preferably 1,2,4-benzenetricarboxylic acid anhydride (trimellitic anhydride);

[15] the method for producing a toner for electrostatic image development according to the above [13] or [14], wherein the content of the tricarboxylic or higher polycarboxylic acid compound is preferably 20% by mol or less, more preferably 10% by mol or less, and even more preferably 5% by mol or less;

[16] the method for producing a toner for electrostatic image development according to any one of the above [1] to [15], wherein the softening point of the amorphous polyester is preferably 80° C. or higher, more preferably 90° C. or higher, and even more preferably 100° C. or higher, and preferably 160° C. or lower, more preferably 140° C. or lower, and even more preferably 120° C. or lower;

[17] the method for producing a toner for electrostatic image development according to any one of the above [1] to [16], wherein the highest temperature of endothermic peak of the amorphous polyester is preferably 50° C. or higher, more preferably 55° C. or higher, and even more preferably 60° C. or higher, and preferably 90° C. or lower, more preferably 80° C. or lower, and even more preferably 70° C. or lower;

[18] the method for producing a toner for electrostatic image development according to any one of the above [1] to [17], wherein the glass transition temperature of the amorphous polyester is preferably 50° C. or higher, more preferably 55° C. or higher, and even more preferably 60° C. or higher, and preferably 90° C. or lower, more preferably 80° C. or lower, and even more preferably 70° C. or lower;

[19] the method for producing a toner for electrostatic image development according to any one of the above [1] to [18], wherein the acid value of the amorphous polyester is preferably 30 mgKOH/g or less, more preferably 20 mgKOH/g or less, and even more preferably 15 mgKOH/g or less, and preferably 1 mgKOH/g or more, more preferably 2 mgKOH/g or more, and even more preferably 3 mgKOH/g or more, from the viewpoint of improving low-temperature fusing ability of the toner;

[20] the method for producing a toner for electrostatic image development according to any one of the above [1] to [19], wherein the degree of crystallinity of the crystalline polylactic acid used in the step 1 is preferably 30% or more, more preferably 50% or more, even more preferably 70% or more, even more preferably 80% or more, and even more preferably 90% or more;

[21] the method for producing a toner for electrostatic image development according to any one of the above [1] to [20], wherein the content of the lactic acid is preferably 80% by mol or more, and more preferably 90% by mol or more, of the monomers constituting the crystalline polylactic acid, and the crystalline polylactic acid is even more preferably a homopolymer of lactic acid;

[22] the method for producing a toner for electrostatic image development according to any one of the above [1] to [21], wherein the number-average molecular weight of the crystalline polylactic acid used in the step 1 is preferably 25,000 or more, more preferably 50,000 or more, even more preferably 100,000 or more, even more preferably 150,000 or more, and even more preferably 180,000 or more, and preferably 300,000 or less, more preferably 250,000 or less, and even more preferably 200,000 or less;

[23] the method for producing a toner for electrostatic image development according to any one of the above [1] to [22], wherein the weight-average molecular weight of the crystalline polylactic acid used in the step 1 is preferably 30,000 or more, more preferably 100,000 or more, even more preferably 250,000 or more, even more preferably 400,000 or more, and even more preferably 450,000 or more, and preferably 700,000 or less, more preferably 550,000 or less, and even more preferably 500,000 or less;

[24] the method for producing a toner for electrostatic image development according to any one of the above [1] to [23], wherein the melting point of the crystalline polylactic acid used in the step 1 is preferably 155° C. or higher, and more preferably 160° C. or higher, and preferably 180° C. or lower, and more preferably 175° C. or lower;

[25] the method for producing a toner for electrostatic image development according to any one of the above [1] to [24], wherein the amount of the crystalline polylactic acid used in the step 1 is preferably 5% by mass or more, more preferably 10% by mass or more, even more preferably 15% by mass or more, and even more preferably 20% by mass or more, of a total amount of the crystalline polylactic acid and the amorphous polyester;

[26] the method for producing a toner for electrostatic image development according to any one of the above [1] to [24], wherein the amount of the crystalline polylactic acid used in the step 1 is preferably 5% by mass or more, more preferably 10% by mass or more, even more preferably 15% by mass or more, even more preferably 20% by mass or more, and even more preferably 30% by mass or more, of a total amount of the crystalline polylactic acid and the amorphous polyester;

[27] the method for producing a toner for electrostatic image development according to any one of the above [1] to [24], wherein the amount of the crystalline polylactic acid used in the step 1 is preferably 5% by mass or more, more preferably 10% by mass or more, even more preferably 15% by mass or more, even more preferably 20% by mass or more, and even more preferably 25% by mass or more, and preferably 50% by mass or less, and more preferably 45% by mass or less, of a total amount of the crystalline polylactic acid and the amorphous polyester;

[28] the method for producing a toner for electrostatic image development according to any one of the above [1] to [27], wherein a mass ratio of the amorphous polyester to the crystalline polylactic acid used in the step 1, i.e. amorphous polyester/crystalline polylactic acid, is preferably from 95/5 to 50/50, more preferably from 90/10 to 50/50, even more preferably from 85/15 to 55/45, even more preferably from 80/20 to 55/45, and even more preferably from 75/25 to 55/45;

[29] the method for producing a toner for electrostatic image development according to any one of the above [1] to [28], wherein in the step 1, the mixing temperature of the amorphous polyester and the crystalline polylactic acid is preferably 150° C. or higher, more preferably 170° C. or higher, and even more preferably 190° C. or higher, and preferably 230° C. or lower, and more preferably 210° C. or lower;

[30] the method for producing a toner for electrostatic image development according to any one of the above [1] to [29], wherein the mixing time in the step 1 is preferably 0.1 hours or more, and more preferably 0.3 hours or more, and preferably 15 hours or less, more preferably 10 hours or less, even more preferably 7 hours or less, even more preferably 5 hours or less, even more preferably 3 hours or less, even more preferably 2 hours or less, and even more preferably 1.5 hours or less;

[31] the method for producing a toner for electrostatic image development according to any one of the above [1] to [30], wherein it is preferable that the step 1 includes:

step 1-1: melting an amorphous polyester; and step 1-2: mixing a molten amorphous polyester and a crystalline polylactic acid at a temperature of from 140° to 250° C.;

[32] the method for producing a toner for electrostatic image development according to any one of the above [1] to [31], wherein it is preferable that the melt-kneading of the step 2 is carried out with an open-roller type kneader;

[33] the method for producing a toner for electrostatic image development according to any one of the above [1] to [32], wherein the content of the crystalline polylactic acid in the toner is preferably 3.0% by mass or more, more preferably 4.0% by mass or more, even more preferably 4.5% by mass or more, even more preferably 5.5% by mass or more, and even more preferably 9.5% by mass or more, and preferably 50% by mass or less, more preferably 45% by mass or less, and even more preferably 40% by mass or less, of a total amount of the crystalline polylactic acid and the amorphous polyester used in the step 1;

[34] the method for producing a toner for electrostatic image development according to any one of the above [1] to [33], wherein the residual ratio of the crystalline polylactic acid in the toner is preferably 10% or more, more preferably 20% or more, even more preferably 25% or more, even more preferably 30% or more, even more preferably 40% or more, even more preferably 60% or more, and even more preferably 70% or more, relative to the crystalline polylactic acid used in the step 1; and

[35] a toner for electrostatic image development obtainable by a method as defined in any one of the above [1] to [34].

EXAMPLES

[Softening Point of Resin]

The softening point refers to a temperature at which half of the sample flows out, when plotting a downward movement of a plunger of a flow tester "CFT-500D," manufactured by Shimadzu Corporation, against temperature, in which a 1 g sample is extruded through a nozzle having a diameter of 1 mm and a length of 1 mm with applying a load of 1.96 MPa thereto with the plunger, while heating the sample so as to raise the temperature at a rate of 6° C./min.

[Highest Temperature of Endothermic Peak of Resin]

Measurements are taken using a differential scanning calorimeter "Q-100," manufactured by TA Instruments, Japan, by weighing out a 0.01 to 0.02 g sample in an aluminum pan, cooling the sample from room temperature to 0° C. at a cooling rate of 10° C./min, keeping the sample at 0° C. for one minute, and thereafter heating the sample at a rate of 50° C./min. Of the endothermic peaks observed, a temperature of the peak of the highest temperature side is defined as a highest temperature of endothermic peak.

[Glass Transition Temperatures of Resin and Crystalline Polylactic Acid]

Measurements are taken using a differential scanning calorimeter "Q-100," manufactured by TA Instruments, Japan, by weighing out a 0.01 to 0.02 g sample in an aluminum pan, heating the sample to 200° C., cooling the sample from that temperature to 0° C. at a cooling rate of 10° C./min, and subsequently heating the sample at a rate of 10° C./min. A temperature of an intersection of the extension of the baseline of equal to or lower than the highest temperature of endothermic peak and the tangential line showing the maximum inclination between the kick-off of the peak and the top of the peak in the above measurement is defined as a glass transition temperature.

[Acid Value of Resin]

The acid value is determined by a method according to JIS K0070 except that only the determination solvent is changed from a mixed solvent of ethanol and ether as prescribed in JIS K0070 to a mixed solvent of acetone and toluene in a volume ratio of acetone:toluene=1:1.

[Degree of Crystallinity of Crystalline Polylactic Acid]

Peak intensities are measured with a powder X-ray diffractometer (XRD) "Rigaku RINT 2500VC X-RAY diffractometer" manufactured by Kabushiki Kaisha Rigaku in accordance with a continuous scanning method, under the conditions of X-ray source: Cu/Kα-radiation, tube voltage: 40 kV, tube current: 120 mA, measurement range: diffraction angle (2θ) of from 5° to 40°, and a scanning speed of 5.0°/minute. Here, the sample is pulverized, and then packed in a glass plate to be measured. The value calculated by the following formula from the X-ray diffraction obtained is referred to as a degree of crystallinity of the crystalline polylactic acid.

$$\text{Degree of Crystallinity (\%)} = \frac{\text{Integral Value of Diffraction Peak Intensitites Derived from Crystals}}{\text{Integral Value of Overall Diffraction Peak Intensities}} \times 100$$

[Melting Point and Endothermic Amount of Crystalline Polylactic Acid]

Measurements are taken using a differential scanning calorimeter "DSC Q20," manufactured by TA Instruments, Japan, by weighing out a 0.01 to 0.02 g sample in an aluminum pan, and heating the sample from 20° to 200° C. at a heating rate of 10° C./min. A highest temperature of endothermic peak observed in the melting endothermic curve obtained is defined as a melting point of a crystalline polylactic acid. In addition, an area under the curve of the peak is defined as an endothermic amount of the crystalline polylactic acid.

[Average Molecular Weight of Crystalline Polylactic Acid]

The number-average molecular weight and the weight-average molecular weight are obtained by measuring a molecular weight distribution in accordance with a gel permeation chromatography (GPC) method as shown by the following method.

(1) Preparation of Sample Solution

A sample is dissolved in chloroform at 25° C. so as to have a concentration of 0.5 g/100 ml. Next, this solution is filtered with a fluororesin filter DISMIC-25JP, manufactured by ADVANTEC, having a pore size of 0.2 μm, to remove an insoluble component, to provide a sample solution.

(2) Measurement of Molecular Weight

Using the following measurement apparatus and analyzing column, measurements are taken by allowing chloroform to flow through the column as an eluent at a flow rate of 1 ml per minute, and stabilizing the column in a thermostat at 40° C., and injecting 100 μl of a sample solution into the column. The molecular weight of the sample is calculated based on the previously drawn calibration curve. At this time, a calibration curve is drawn from several kinds of monodisperse polystyrenes manufactured by Tosoh Corporation, A-500 ($5.0\times10^2$), A-1000 ($1.01\times10^3$), A-2500 ($2.63\times10^3$), A-5000 ($5.97\times10^3$), F-1 ($1.02\times10^4$), F-2 ($1.81\times10^4$), F-4 ($3.97\times10^4$), F-10 ($9.64\times10^4$), F-20 ($1.90\times10^5$), F-40 ($4.27\times10^5$), F-80 ($7.06\times10^5$), and F-128 ($1.09\times10^6$) as standard samples.

Measurement Apparatus: HLC-8220GPC manufactured by Tosoh Corporation

Analyzing Column: GMHLX+G3000HXL manufactured by Tosoh Corporation

[Melting Point of Releasing Agent]

Measurements are taken using a differential scanning calorimeter "DSC Q20," manufactured by TA Instruments, Japan, by weighing out a 0.01 to 0.02 g sample in an aluminum pan, heating the sample to 200° C. at a heating rate of 10° C./min, cooling the sample from that temperature to −10° C. at a cooling rate of 5° C./min, and subsequently heating the sample at a rate of 10° C./min to 180° C. A highest temperature of endothermic peak observed in the melting endothermic curve obtained is defined as a melting point of a wax.

[Volume-Average Particle Size of External Additive]

The volume-average particle size of the primary particles is obtained by the following formula:

$$\text{Average Particle Size (nm)} = 6/(\rho \times \text{Specific Surface Area}(m^2/g)) \times 1000$$

wherein ρ is a true specific gravity of an external additive; for example, in a case of silica, the true specific gravity is 2.2; and a specific surface area is a BET specific surface area obtained by nitrogen adsorption method. Incidentally, the above formula is obtained from:

$$\text{Specific Surface Area} = S \times (1/m)$$

wherein m(Mass of Particles)=$4/3 \times \pi \times (R/2)^3 \times$True Specific Gravity, and $$S(\text{Surface Area}) = 4\pi(R/2)^2,$$

supposing that a sphere has a particle size R.

[Melting Point, Endothermic Amount, Content, and Residual Ratio of Crystalline Polylactic Acid in Toner]

Measurements are taken using a differential scanning calorimeter "Q-100," manufactured by TA Instruments, Japan, by weighing out a 0.01 to 0.02 g toner sample in an aluminum pan, and heating the toner sample from 0° to 200° C. at a heating rate of 10° C./min. In the endothermic curve obtained, the presence or absence of the crystalline polylactic acid in the toner is judged by the presence or absence of endothermic peak, i.e. crystal melting peak, ascribed to crystal melting in the region of from a temperature calculated as a melting point minus 30° C. of the crystalline polylactic acid to a temperature calculated as a melting point plus 5° C. of the crystalline polylactic acid, on the basis of the melting point of the crystalline polylactic acid obtained by the measurement method described above. A temperature of the crystal melting peak and an area under the curve thereof are respectively referred to as a melting point and an endothermic amount of the crystalline polylactic acid in the toner. The content and the residual ratio of the crystalline polylactic acid in the toner are obtained by the following formulas:

$$\text{Content of Crystalline Polylactic Acid in Toner (\% by Mass)}^{a)} = \frac{\text{Endothermic Amount of Crystalline Polylactic Acid in Toner (J/g)} \times \left[100 + \text{Amount of Toner Raw Materials Other Than Resin Used (Parts by Mass)}^{a)}\right] \times \left[100 + \text{Amount of External Additive Used (Parts by Mass)}^{b)}\right]}{\text{Endothermic Amount of Raw Material Crystalline Polylactic Acid (J/g)}} \times 100$$

*a*) Value when a total amount of the amorphous polyester and the crystalline polylactic acid is assumed to be 100.

*b*) Value of only external additive, when the toner matrix particles are assumed to be 100.

$$\text{Residual Ratio of Crystalline Polylactic Acid in Toner (\% by Mass)}^{a)} = \frac{\text{Endothermic Amount of Crystalline Polylactic Acid in Toner (J/g)} \times \left[100 + \text{Amount of Toner Raw Materials Other Than Resin Used (Parts by Mass)}^{b)}\right] \times \left[100 + \text{Amount of External Additive Used (Parts by Mass)}^{c)}\right]}{\text{Endothermic Amount of Raw Material Crystalline Polylactic Acid (J/g)} \times \text{Amount of Crystalline Polylactic Acid Used (Parts by Mass)}^{b)}}$$

*a*) Residual ratio (%) when the amount of the crystalline polylactic acid used is assumed to be 100.

*b*) Value when a total amount of the amorphous polyester and the crystalline polylactic acid is assumed to be 100.

*c*) Value of only external additive, when the toner matrix particles are assumed to be 100.

Incidentally, when it is difficult to judge the endothermic peak ascribed to the crystalline polylactic acid due to other components such as a crystalline polyester or a high-melting point wax in the toner, the measurements are made by appropriately subjecting other components in the toner to a treatment such as dissolution or separation.

[Volume-Median Particle Size of Toner]

Measurement Apparatus: Coulter Multisizer II manufactured by Beckman Coulter, Inc.

Aperture Diameter: 100 μm

Analyzing Software: Coulter Multisizer AccuComp Ver. 1.19 manufactured by Beckman Coulter, Inc.

Electrolytic solution: "Isotone II" manufactured by Beckman Coulter, Inc. Dispersion: "EMULGEN 109P" manufactured by Kao Corporation, polyoxyethylene lauryl ether, HLB: 13.6, is dissolved in the above electrolytic solution so as to have a concentration of 5% by mass to provide a dispersion.

Dispersion Conditions: Ten milligrams of a measurement sample is added to 5 ml of the above dispersion, and the mixture is dispersed with an ultrasonic disperser for 1 minute, and 25 ml of the above electrolytic solution is added to the dispersion, and further dispersed with the ultrasonic disperser for 1 minute, to prepare a sample dispersion. Measurement Conditions: The above sample dispersion is added to 100 ml of the above electrolytic solution to adjust to a concentration at which particle sizes of 30,000 particles can be measured in 20 seconds, and thereafter the 30,000 particles are measured, and a volume-median particle size $D_{50}$ is obtained from the particle size distribution.

[Production Example 1 of Resins: PES-1, PES-2]

A 5-liter four-neck flask equipped with a nitrogen inlet tube, a dehydration tube equipped with a fractional distillation tube through which hot water at 98° C. was allowed to flow, a stirrer, and a thermocouple was charged with raw material monomers other than trimellitic anhydride and an esterification catalyst, as listed in Table 1. The mixture was heated under nitrogen atmosphere from room temperature to 180° C. over a period of about 2 hours, and thereafter heated from 180° to 210° C. at a rate of 10° C./hr, and the heated mixture was allowed to react at 210° C. until a reaction percentage reached 90%. Thereafter, trimellitic anhydride was added thereto, and the mixture was subjected to a reaction at 210° C. and normal pressure for 1 hour, and subjected to a reaction at 20 kPa until a desired softening point was reached, to provide each of amorphous polyesters (PES-1, PES-2). The physical properties of PES-1 and PES-2 are shown in Table 1. Here, the reaction percentage refers to a value calculated by: [amount of generated water in reaction/theoretical amount of generated water]×100.

[Production Example 2 of Resin: PES-3]

A 5-liter four-neck flask equipped with a nitrogen inlet tube, a dehydration tube, a stirrer, and a thermocouple was charged with raw material monomers and an esterification catalyst, as listed in Table 1. The mixture was heated under nitrogen atmosphere from room temperature to 200° C. over a period of about 2 hours, and thereafter heated from 200° to 230° C. at a rate of 10° C./hr, and the heated mixture was allowed to react at 230° C. until a reaction percentage reached 90%. Thereafter, the mixture was subjected to a reaction at 20 kPa until a softening point reached 112° C., to provide an amorphous polyester (PES-3). The physical properties of PES-3 are shown in Table 1.

[Production Example 3 of Resin: PES-4]

A 5-liter four-neck flask equipped with a nitrogen inlet tube, a dehydration tube, a stirrer, and a thermocouple was charged with raw material monomers other than trimellitic anhydride, and an esterification catalyst, and a polymerization inhibitor as listed in Table 1. The mixture was heated under nitrogen atmosphere from room temperature to 200° C. over a period of about 2 hours, and thereafter heated from 200° to 230° C. at a rate of 10° C./hr, and the heated mixture was allowed to react at 230° C. until a reaction percentage reached 90%. Thereafter, trimellitic anhydride was added thereto, and the mixture was subjected to a reaction at 20 kPa until a softening point reached 112° C., to provide an amorphous polyester (PES-4). The physical properties of PES-4 are shown in Table 1.

TABLE 1

| | | PES-1 | PES-2 | PES-3 | PES-4 |
|---|---|---|---|---|---|
| Raw Material Monomers | 1,2-Propanediol | 1,522 g (100) | 1,217 g (80) | — | — |
| | 1,4-Butanediol | — | 360 g (20) | — | — |
| | BPA-PO[1)] | — | — | 1,103 g (35) | 2,835 g (90) |
| | BPA-EO[2)] | — | — | 1,901 g (65) | 293 g (10) |
| | Terephthalic Acid | 2,658 g (80) | 2,658 g (80) | 1,330 g (89) | — |
| | Fumaric Acid | — | — | — | 992 g (95) |
| | Trimellitic Anhydride | 135 g (3.5) | 154 g (4.0) | 17 g (1) | 52 g (3) |
| Esterification Catalyst | Dibutyltin Oxide | 8.6 g | 8.8 g | 8.7 g | 8.3 g |
| Polymerization Inhibitor | t-Butyl Catechol | — | — | — | 2.1 g |
| Physical Properties of Resins | Softening Point, ° C. | 111 | 112 | 112 | 112 |
| | Highest Temperature of Endothermic Peak, ° C. | 64 | 65 | 67 | 65 |
| | Softening Point/ Highest Temperature of Endothermic Peak | 1.73 | 1.72 | 1.67 | 1.72 |
| | Glass Transition Temperature, ° C. | 62 | 64 | 65 | 63 |
| | Acid Value, mgKOH/g | 6.2 | 13.2 | 4.2 | 10.1 |

Note)

Numerical FIGURES inside parenthesis is a molar ratio when a total of the alcohol component is assumed to be 100.

[1)]Polyoxypropylene(2.2)-2,2-bis(4-hydroxyphenyl)propane

[2)]Polyoxyethylene(2.2)-2,2-bis(4-hydroxyphenyl)propane

[Production Example 4 of Resin: PLA-3]

A crystalline polylactic acid "N-3000" manufactured by Nature Works LLC was placed in a vat having sizes of 35 cm×25 cm, and allowed to stand under environmental conditions of a temperature of 80° C., and humidity of 95% for 48 hours, to provide PLA-3.

[Production Example 5 of Resin: PLA-4]

The same procedures as in the method for PLA-3 were carried out except for changing the time that was allowed to stand to 6 hours, to provide PLA-4.

[Production Example 6: PLA-5]

The same procedures as in the method for PLA-3 were carried out except for changing the time that was allowed to stand to 3 hours, to provide PLA-5.

The number-average molecular weight Mn, the weight-average molecular weight Mw, the melting point, the glass transition temperature, the degree of crystallinity, and the endothermic amount of PLA-1 to PLA-5 used in Examples and Comparative Examples are listed in Table 2.

TABLE 2

| | | Mn | Mw | Melting Point, ° C. | Glass Transition Temp., ° C. | Degree of Crystallinity, % | Endo-thermic Amount, J/g |
|---|---|---|---|---|---|---|---|
| PLA-1 | N-3000, manufactured by Nature Works LLC | 188,000 | 472,000 | 170 | 63 | 92 | 34.6 |
| PLA-2 | N-4000, manufactured by Nature Works LLC | 238,000 | 524,000 | 170 | 61 | 95 | 29.8 |
| PLA-3 | Production Example 4 of Resin | 27,000 | 40,000 | 162 | 58 | 91 | 6.7 |
| PLA-4 | Production Example 5 of Resin | 80,000 | 138,000 | 170 | 62 | 90 | 18.8 |
| PLA-5 | Production Example 6 of Resin | 132,000 | 321,000 | 170 | 62 | 94 | 22.2 |

[Production Examples of Toners]

Examples 1 to 24 and Comparative Examples 2 to 5

(Step 1)

A 10-liter four-neck flask equipped with a nitrogen inlet tube, a dehydration tube, a stirrer, and a thermocouple was charged with an amorphous polyester in a given amount as listed in Table 3 or 4. The content was heated to a temperature as listed in Table 3 or 4 under nitrogen atmosphere, to melt the amorphous polyester. Thereafter, a crystalline polylactic acid in a given amount as listed in Table 3 or 4 was added thereto, and the mixture was stirred for a given period of time as listed in Table 3 or 4. The resulting mixture was cooled to a temperature of 40° C. or lower, and thereafter roughly pulverized with Rotoplex manufactured by Hosokawa Micron Corporation, and allowed to pass through a mesh having a circular hole with a diameter of 3 mm, to provide a mixture having an average particle size of 0.5 mm.

(Step 2)

One hundred parts by mass of the mixture obtained in the step 1, 4.0 parts by mass of a colorant "ECB-301" manufactured by DAINICHISEIKA COLOR & CHEMICALS MFG. CO., LTD., Phthalocyanine Blue, P.B. 15:3, 0.5 parts by mass of a negatively chargeable charge control agent "BONTRON E-304" manufactured by Orient Chemical Industries Co., Ltd., and 3.0 parts by mass of a releasing agent "HNP-9" manufactured by NIPPON SEIRO CO., LTD., paraffin wax, melting point: 75° C. were mixed with a Henschel mixer for one minute, and thereafter melt-kneaded under the conditions shown below.

A continuous twin open-roller type kneader "Kneadex," manufactured by MITSUI MINING COMPANY, LIMITED, having an outer diameter of roller of 14 cm and an effective length of roller of 80 cm, was used. The operating conditions of the continuous twin open-roller type kneader were a peripheral speed of a high-rotation roller, a front roller, of 32.4 m/min, a peripheral speed of a low-rotation roller, a back roller, of 21.7 m/min, and a gap between the rollers of 0.1 mm. The temperatures of the heating medium and the cooling medium inside the rollers were as follows. The high-rotation roller had a temperature at the raw material supplying side of 135° C., and a temperature at the kneaded product discharging side of 90° C., and the low-rotation roller had a temperature at the raw material supplying side of 35° C., and a temperature at the kneaded product discharging side of 35° C. In addition, the feeding rate of the raw material mixture was 4 kg/h, and the average residence time was about 6 minutes.

(Step 3)

The melt-kneaded product was cooled, and then roughly pulverized with a hammer-mill manufactured by Hosokawa Micron Corporation to an average particle size of 1 mm. The resulting roughly pulverized product was finely pulverized with a fluidized bed jet mill "AFG-200" manufactured by HOSOKAWA ALPINE AG, and the finely pulverized product was classified with a rotor-type classifier "TTSP-100" manufactured by HOSOKAWA ALPINE AG, to provide toner matrix particles having a volume-median particle size $D_{50}$ of 6.5 μm.

One hundred parts by mass of the toner matrix particles obtained were mixed with 1.0 part by mass of a hydrophobic silica "R972" manufactured by Nippon Aerosil Co., Ltd., volume-average particle size: 16 nm and 1.0 part by mass of a hydrophobic silica "NAX50" manufactured by Nippon Aerosil Co., Ltd., volume-average particle size: 30 nm with a Henschel mixer manufactured by MITSUI MINING COMPANY, LIMITED at 2,100 r/min, i.e. a peripheral speed of 29 m/sec, for 3 minutes, to provide each of the toners.

Example 25

In the step 1, a 10-liter four-neck flask equipped with a nitrogen inlet tube, a dehydration tube, a stirrer, and a thermocouple was charged with an amorphous polyester and a crystalline polyester in given amounts as listed in Table 3. The content was stirred for a given period of time as listed in Table 3 under nitrogen atmosphere. The resulting mixture was cooled to a temperature of 40° C. or lower, and thereafter roughly pulverized with Rotoplex manufactured by Hosokawa Micron Corporation, and allowed to pass through a mesh having a circular hole with a diameter of 3 mm, to provide a mixture having an average particle size of 0.5 mm.

The same procedures as in Example 1 were carried out except that the step 1 was carried out in accordance with the above method, to provide a toner.

Comparative Examples 1, and 6 to 8

An amorphous polyester and a crystalline polylactic acid in given amounts as listed in Table 4, 4.0 parts by mass of a colorant "ECB-301" manufactured by DAINICHISEIKA COLOR & CHEMICALS MFG. CO., LTD., Phthalocyanine Blue, P.B. 15:3, 0.5 parts by mass of a negatively chargeable charge control agent "BONTRON E-304" manufactured by Orient Chemical Industries Co., Ltd., and 3.0 parts by mass of a releasing agent "HNP-9" manufactured by NIPPON SEIRO CO., LTD., paraffin wax, melting point: 75° C. were mixed with a Henschel mixer for one minute, and thereafter melt-kneaded, pulverized, and classified in the same manner as in Example 1. However, the resulting particles were not compatible with the amorphous polyester and the crystalline polylactic acid, but separated therefrom, which were impractical to be used in toners.

Comparative Examples 9 to 12

The same procedures as in Example 1 were carried out except that a crystalline polylactic acid was not used, and that the step 1 was omitted, to provide a toner.

[Test Example 1: High-Temperature Offset Resistance]

Each of the toners was loaded in a printer "ML-5400," manufactured by Oki Data Corporation, which was modified so as to obtain non-fused images, and non-fused images of a solid image having a size of 3 cm×4 cm were printed out. The resulting non-fused images were subjected to a fusing treatment at each temperature with an external fusing device, which was a fusing device modifying an oilless fusing system "Microline 3010" manufactured by Oki Data Corporation for external fusing, while setting a rotational speed of the fusing roller to 100 mm/sec and raising the temperature of the fusing roller from 100° to 200° C. with an increment of 5° C. A temperature at which soiling of the fusing roller was generated on a blank sheet portion is defined as a temperature of high-temperature offset generation, and used as an index for high-temperature offset resistance. The higher the temperature of high-temperature offset generation, the more excellent the high-temperature offset resistance. The results are shown in Tables 3 and 4. In the fused images at 200° C., when the generation of the high-temperature offset was not observed, it was listed as "200<."

[Test Example 2: Durability Test]

Each of the toners was loaded to an ID cartridge "image drum, for ML-5400" manufactured by Oki Data Corporation, which was modified so that the developer roller could be visually observed, and idle runs were carried out at 70 r/min (equivalent to 36 ppm), under conditions of a temperature of 30° C. and humidity of 50%, and the filming formed on the developer roller was visually observed. The time period until filming was generated was used as an index for durability. The longer the time period until filming was generated, the more excellent the durability. The results are shown in Tables 3 and 4.

[Test Example 3: Heat-Resistant Storage Property]

A 20-ml polypropylene container was charged with 4 g of a toner. The toner-containing container was placed in a thermohygrostat kept at 55° C. and a relative humidity of 80%, and the toner was stored for 48 hours in an open state without placing a lid of the container. The degree of aggregation of the toner after storage was measured, which was used as an index for heat-resistant storage property. The smaller this numerical value, the more excellent the heat-resistant storage property. The results are shown in Tables 3 and 4.

(Degree of Aggregation)

The degree of aggregation is measured with a powder tester manufactured by Hosokawa Micron Corporation.

Sieves having opening of 150 μm, 75 μm, and 45 μm are stacked on top of each other, 4 g of a toner is placed on the top sieve, and the sieves are vibrated at an oscillation width of 1 mm for 60 seconds. After the vibration, an amount of the toner remaining on the sieve is measured, and the degree of aggregation is calculated using the following sets of formulas:

$$\text{Degree of Aggregation} = a + b + c, \text{ wherein}$$

$$a = \frac{\text{Mass of Toner Remaining on Top Sieve}}{\text{Amount of Sample}} \times 100$$

$$b = \frac{\text{Mass of Toner Remaining on Middle Sieve}}{\text{Amount of Sample}} \times 100 \times \frac{3}{5}$$

$$c = \frac{\text{Mass of Toner Remaining on Bottom Sieve}}{\text{Amount of Sample}} \times 100 \times \frac{1}{5}$$

TABLE 3

| | Amorphous Polyester | | Crystalline Polylactic Acid | | | | Presence or Absence of | Crystalline Polylactic Acid in Toner | |
|---|---|---|---|---|---|---|---|---|---|
| | | | | | Step 1 | | | | |
| | Kind | Parts by Mass | Kind | Parts by Mass | Temp., ° C. | Time, hr | Crystalline Polylactic Acid in Toner | Melting Point, ° C. | Endothermic Amount, J/g |
| Ex. 1 | PES-1 | 80 | PLA-1 | 20 | 200 | 0.5 | present | 154 | 6.2 |
| Ex. 2 | PES-1 | 80 | PLA-1 | 20 | 200 | 1 | present | 153 | 3.2 |

TABLE 3-continued

| | | | | | | | | | |
|---|---|---|---|---|---|---|---|---|---|
| Ex. 3 | PES-1 | 80 | PLA-1 | 20 | 200 | 2 | present | 152 | 2.3 |
| Ex. 4 | PES-1 | 80 | PLA-1 | 20 | 200 | 3 | present | 151 | 1.5 |
| Ex. 5 | PES-1 | 80 | PLA-1 | 20 | 180 | 1 | present | 154 | 4.2 |
| Ex. 6 | PES-1 | 80 | PLA-1 | 20 | 180 | 5 | present | 153 | 1.5 |
| Ex. 7 | PES-1 | 80 | PLA-1 | 20 | 150 | 1 | present | 156 | 4.3 |
| Ex. 8 | PES-1 | 80 | PLA-1 | 20 | 150 | 5 | present | 154 | 3.2 |
| Ex. 9 | PES-1 | 80 | PLA-1 | 20 | 150 | 10 | present | 154 | 1.3 |
| Ex. 10 | PES-1 | 80 | PLA-1 | 20 | 250 | 0.5 | present | 150 | 1.2 |
| Ex. 11 | PES-2 | 80 | PLA-1 | 20 | 200 | 0.5 | present | 155 | 6.1 |
| Ex. 12 | PES-3 | 80 | PLA-1 | 20 | 200 | 0.5 | present | 154 | 5.9 |
| Ex. 13 | PES-4 | 80 | PLA-1 | 20 | 200 | 0.5 | present | 153 | 4.6 |
| Ex. 14 | PES-1 | 50 | PLA-1 | 50 | 200 | 0.5 | present | 154 | 15.5 |
| Ex. 15 | PES-1 | 60 | PLA-1 | 40 | 200 | 0.5 | present | 154 | 12.4 |
| Ex. 16 | PES-1 | 70 | PLA-1 | 30 | 200 | 0.5 | present | 155 | 9.1 |
| Ex. 17 | PES-1 | 90 | PLA-1 | 10 | 200 | 0.5 | present | 155 | 2.9 |
| Ex. 18 | PES-1 | 95 | PLA-1 | 5 | 200 | 0.5 | present | 154 | 1.4 |
| Ex. 19 | PES-1 | 80 | PLA-2 | 20 | 200 | 0.5 | present | 154 | 5.4 |
| Ex. 20 | PES-1 | 80 | PLA-3 | 20 | 200 | 0.5 | present | 151 | 1.1 |
| Ex. 21 | PES-1 | 80 | PLA-4 | 20 | 200 | 0.5 | present | 151 | 3.3 |
| Ex. 22 | PES-1 | 80 | PLA-5 | 20 | 200 | 0.5 | present | 153 | 3.8 |
| Ex. 23 | PES-1 | 80 | PLA-1 | 20 | 170 | 1 | present | 156 | 6.2 |
| Ex. 24 | PES-1 | 80 | PLA-1 | 20 | 170 | 5 | present | 155 | 5.2 |
| Ex. 25 | PES-1 | 80 | PLA-1 | 20 | 200 | 1 | present | 153 | 1.7 |

| | Crystalline Polylactic Acid in Toner | | Properties of Toner | | |
|---|---|---|---|---|---|
| | Content, % by Mass | Residual Ratio, % | High-Temp. Offset Resistance, ° C. | Durabilly, hr | Heat-Resistant Storage Property |
| Ex. 1 | 19.6 | 98.2 | 200< | 12.0 | 12.6 |
| Ex. 2 | 10.0 | 50.1 | 200< | 13.0 | 8.9 |
| Ex. 3 | 7.2 | 35.8 | 200< | 11.5 | 14.5 |
| Ex. 4 | 4.8 | 24.3 | 185 | 7.5 | 23.2 |
| Ex. 5 | 13.2 | 65.8 | 200< | 12.5 | 10.5 |
| Ex. 6 | 4.8 | 24.3 | 200< | 9.0 | 15.2 |
| Ex. 7 | 13.5 | 67.6 | 200< | 12.5 | 13.9 |
| Ex. 8 | 10.0 | 50.1 | 200< | 12.0 | 9.5 |
| Ex. 9 | 4.2 | 20.8 | 200< | 10.5 | 16.7 |
| Ex. 10 | 3.8 | 18.9 | 180 | 8.0 | 17.2 |
| Ex. 11 | 19.3 | 96.7 | 200< | 14.5 | 13.2 |
| Ex. 12 | 18.7 | 93.4 | 200< | 14.0 | 9.7 |
| Ex. 13 | 14.7 | 73.6 | 200< | 10.0 | 10.3 |
| Ex. 14 | 49.1 | 98.3 | 200< | 9.0 | 7.2 |
| Ex. 15 | 39.3 | 98.3 | 200< | 14.0 | 8.6 |
| Ex. 16 | 28.7 | 95.8 | 200< | 14.5 | 8.9 |
| Ex. 17 | 9.3 | 92.9 | 195 | 11.0 | 16.7 |
| Ex. 18 | 4.3 | 86.3 | 175 | 7.0 | 18.7 |
| Ex. 19 | 20.6 | 99.5 | 200< | 12.5 | 13.1 |
| Ex. 20 | 18.5 | 92.5 | 175 | 6.0 | 12.9 |
| Ex. 21 | 19.3 | 96.5 | 200< | 9.0 | 13.5 |
| Ex. 22 | 18.7 | 93.6 | 200< | 10.5 | 12.4 |
| Ex. 23 | 19.8 | 99.0 | 200< | 13.5 | 9.5 |
| Ex. 24 | 16.6 | 82.9 | 200< | 13.0 | 9.8 |
| Ex. 25 | 5.4 | 26.8 | 195 | 8.5 | 25.4 |

TABLE 4

| | Amorphous Polyester | | Crystalline Polylactic Acid | | | | Presence or Absence of Crystalline Polylactic Acid in Toner | Properties of Toner | | |
|---|---|---|---|---|---|---|---|---|---|---|
| | | | | | Step 1 | | | High-Temp. Offset Resistance, ° C. | Durability, hr | Heat-Resistant Storage Property |
| | Kind | Parts by Mass | Kind | Parts by Mass | Temp., ° C. | Time, hr | | | | |
| Comp. Ex. 1 | PES-1 | 80 | PLA-1 | 20 | — | — | — | unable to form a toner[1)] | | |
| Comp. Ex. 2 | PES-1 | 80 | PLA-1 | 20 | 200 | 4 | absent | 160 | 3.0 | 36.5 |
| Comp. Ex. 3 | PES-1 | 80 | PLA-1 | 20 | 200 | 5 | absent | 145 | 0.1 | 52.8 |
| Comp. Ex. 4 | PES-1 | 80 | PLA-1 | 20 | 180 | 7 | absent | 170 | 4.5 | 29.2 |
| Comp. Ex. 5 | PES-1 | 80 | PLA-1 | 20 | 250 | 1 | absent | 140 | 2.0 | 32.2 |
| Comp. Ex. 6 | PES-2 | 80 | PLA-1 | 20 | — | — | — | unable to form a toner[1)] | | |
| Comp. Ex. 7 | PES-3 | 80 | PLA-1 | 20 | — | — | — | unable to form a toner[1)] | | |

TABLE 4-continued

| | Amorphous Polyester | | Crystalline Polylactic Acid | | Step 1 | | Presence or Absence of Crystalline | Properties of Toner | | |
|---|---|---|---|---|---|---|---|---|---|---|
| | Kind | Parts by Mass | Kind | Parts by Mass | Temp., ° C. | Time, hr | Polylactic Acid in Toner | High-Temp. Offset Resistance, ° C. | Durability, hr | Heat-Resistant Storage Property |
| Comp. Ex. 8 | PES-4 | 80 | PLA-1 | 20 | — | — | — | unable to form a toner[1)] | | |
| Comp. Ex. 9 | PES-1 | 100 | — | — | — | — | — | 150 | 0.5 | 26.5 |
| Comp. Ex. 10 | PES-2 | 100 | — | — | — | — | — | 155 | 2.0 | 27.2 |
| Comp. Ex. 11 | PES-3 | 100 | — | — | — | — | — | 150 | 2.0 | 26.0 |
| Comp. Ex. 12 | PES-4 | 100 | — | — | — | — | — | 150 | 1.0 | 29.2 |

[1)]The amorphous polyester and the crystalline polylactic acid are being separated without melting together.

It can be seen from the results of Tables 3 and 4 that the toners of Examples 1 to 25 are excellent in all of high-temperature offset resistance, durability, and heat-resistant storage property, as compared to the toners of Comparative Examples 2 to 5, and 9 to 12 not containing the crystalline polylactic acid.

INDUSTRIAL APPLICABILITY

The toner for electrostatic image development obtainable by the method of the present invention is suitably used in development or the like of latent images formed in an electrostatic development method, an electrostatic recording method, an electrostatic printing method, or the like,

The invention claimed is:

1. A method for producing a toner for electrostatic image development comprising at least an amorphous polyester and a crystalline polylactic acid, the method comprising:

mixing an amorphous polyester and a crystalline polylactic acid having a number-average molecular weight of 50,000 or more and 300,000 or less at a temperature of from 140° to 250° C.;

melt-kneading a mixture obtained from said mixing; and pulverizing and classifying a melt-kneaded product obtained from said melt-kneading, wherein a mass ratio of the amorphous polyester to the crystalline polylactic acid present during the mixing is from 90/10 to 50/50, and wherein a content of the crystalline polylactic acid in the toner is 5.5% by mass or more of a total amount of the amorphous polyester and the crystalline polylactic acid present during said mixing.

2. The method for producing a toner for electrostatic image development according to claim 1, wherein a mass ratio of the amorphous polyester to the crystalline polylactic acid present during said mixing is from 85/15 to 50/50.

3. The method for producing a toner for electrostatic image development according to claim 1, wherein said mixing comprises:

melting an amorphous polyester; and mixing a molten amorphous polyester and a crystalline polylactic acid at a temperature of from 140° to 250° C.

4. The method for producing a toner for electrostatic image development according to claim 1, wherein the amorphous polyester is obtained by polycondensing an alcohol component and a carboxylic acid component, and the alcohol component is at least one member selected from the group consisting of an aliphatic diol, an alicyclic diol, and an aromatic diol.

5. The method for producing a toner for electrostatic image development according to claim 4, wherein the aliphatic diol comprises an aliphatic diol having a hydroxyl group bonded to a secondary carbon atom.

6. The method for producing a toner for electrostatic image development according to claim 5, wherein the number of carbon atoms of the aliphatic diol having a hydroxyl group bonded to a secondary carbon atom is 3 or more and 6 or less.

7. The method for producing a toner for electrostatic image development according to claim 5, wherein the alcohol component comprises an aliphatic diol, and the content of the aliphatic diol having a hydroxyl group bonded to a secondary carbon atom is 50% by mol or more and 100% by mol or less of the alcohol component.

8. The method for producing a toner for electrostatic image development according to claim 4, wherein the aromatic diol is an alkylene oxide adduct of bisphenol A represented by formula (I):

(I)

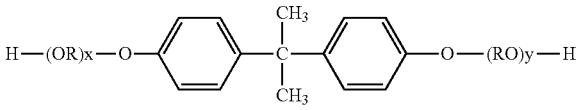

wherein each of RO and OR represents an oxyalkylene group, wherein R represents an ethylene, propylene group, or a combination thereof, and wherein x and y each represents a number of moles of the alkylene oxide added, each being a positive number, and the sum of x and y on average is from 1 to 16.

9. The method for producing a toner for electrostatic image development according to claim 4, wherein the alcohol component comprises an aromatic diol, and the content of the aromatic diol is 50% by mol or more and 100% by mol or less of the alcohol component.

10. The method for producing a toner for electrostatic image development according to claim 1, wherein the degree of crystallinity of the crystalline polylactic acid present during said mixing is 30% or more.

11. The method for producing a toner for electrostatic image development according to claim 1, wherein the mixing time of said mixing is 0.1 hours or more and 15 hours or less.

12. The method for producing a toner for electrostatic image development according to claim 1, wherein said melt-kneading is carried out with an open-roller type kneader.

13. The method for producing a toner for electrostatic image development according to claim 1, wherein the softening point of the amorphous polyester is 80° C. or higher and 160° C. or lower.

14. The method for producing a toner for electrostatic image development according to claim 1, wherein the number-average molecular weight of the crystalline polylactic acid is 80,000 or more and 300,000 or less.

15. The method for producing a toner for electrostatic image development according to claim 1, wherein the content of the crystalline polylactic acid in the toner is 5.5% by mass or more and 50% by mass or less, of a total amount of the amorphous polyester and the crystalline polylactic acid present during said mixing.

16. The method for producing a toner for electrostatic image development according to claim 1, wherein a mass ratio of the amorphous polyester to the crystalline polylactic acid present during said mixing is from 80/20 to 55/45.

17. The method for producing a toner for electrostatic image development according to claim 1, wherein, during said mixing, the mixing temperature of the amorphous polyester and the crystalline polylactic acid is 150° C. or higher and 230° C. or lower.

18. The method for producing a toner for electrostatic image development according to claim 1, wherein the melting point of the crystalline polylactic acid present during said mixing is 155° C. or higher and 180° C. or lower.

19. A toner for electrostatic image development obtained by the method as defined in claim 1.

20. The method of claim 1, wherein the residual ratio of the crystalline polylactic acid in the toner is 30% or more, relative to an amount of the crystalline polylactic acid in the mixing with the amorphous polyester.

* * * * *